United States Patent [19]

Jonelis

[11] Patent Number: 4,516,992

[45] Date of Patent: May 14, 1985

[54] APPARATUS AND METHOD FOR STRAIGHTENING ELECTROSTATIC PRECIPITATOR COLLECTOR PLATES

[76] Inventor: Robert E. Jonelis, 142 W. Lake Shore Dr., Tower Lakes, Barrington, Ill. 60010

[21] Appl. No.: 555,530

[22] Filed: Nov. 28, 1983

[51] Int. Cl.[3] ..... B03C 3/47

[52] U.S. Cl. ..... 55/145; 55/147; 55/148; 29/825; 52/222

[58] Field of Search ..... 55/145, 147, 148; 29/825; 52/222

[56] References Cited

U.S. PATENT DOCUMENTS

| | | | |
|---|---|---|---|
| 2,866,517 | 12/1958 | Phyl | 55/148 |
| 3,277,622 | 10/1966 | Jensen | 52/222 |
| 3,300,850 | 1/1967 | Stevernagel | 55/148 |
| 3,643,391 | 2/1972 | Mollinger | 52/222 |
| 3,803,809 | 4/1974 | Gelhaar et al. | 55/148 |
| 3,892,545 | 7/1975 | Göransson | 55/148 |
| 4,007,023 | 2/1977 | Bätza et al. | 55/148 |
| 4,047,907 | 9/1977 | Knutsson et al. | 55/148 |

*Primary Examiner*—David L. Lacey
*Attorney, Agent, or Firm*—Anthony S. Zummer

[57] ABSTRACT

This invention relates to an improved method and construction for straightening collector plates in an electrostatic precipitator by employing a torque bar. The torque bar includes an elongated bar which is positioned in an edge of a collector plate. A bracket is fixed to one end of the elongated bar. The bracket has an offset. A connector has one end fixed to a fixed portion of the electrostatic precipitator. A lock secures the bracket to the connector at a selected position to hold the elongated bar in a selected attitude. The method of straightening the plate includes a step of applying a torque moment to the elongated bar to apply a torque moment to the plate to straighten the plate.

14 Claims, 6 Drawing Figures

FIG. 1
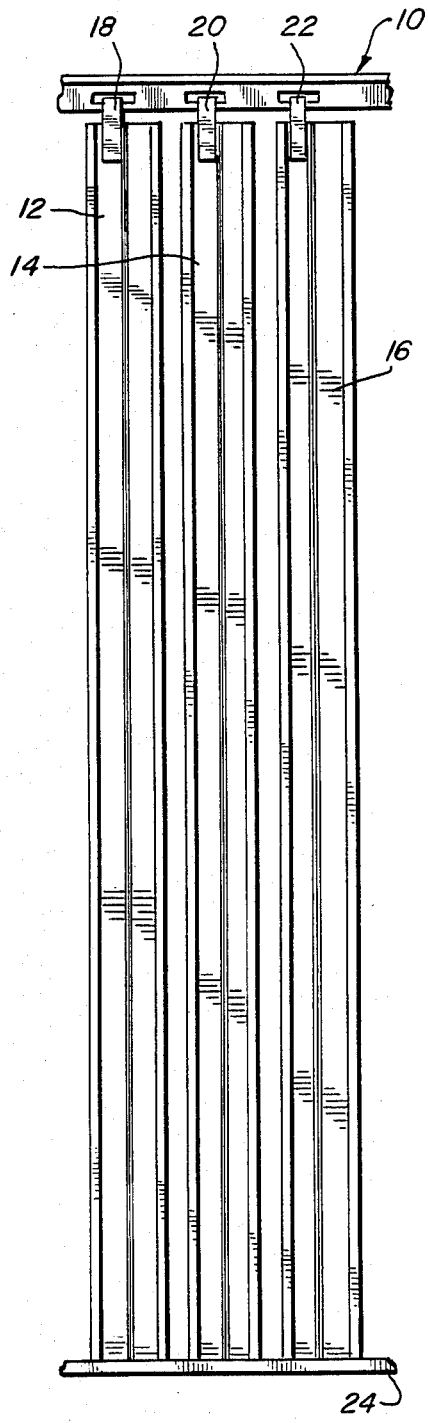
FIG. 2
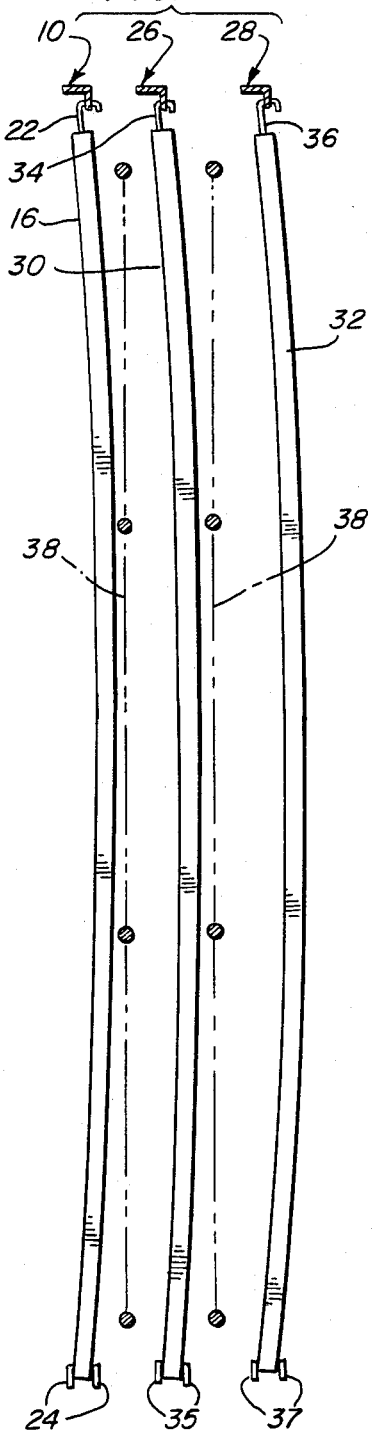
FIG. 3
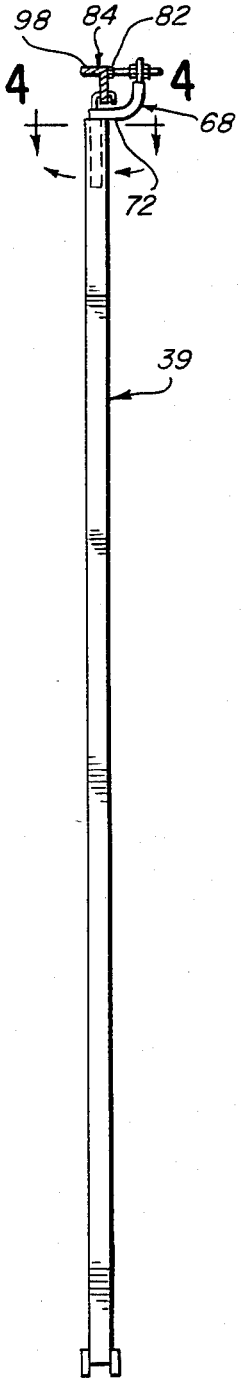
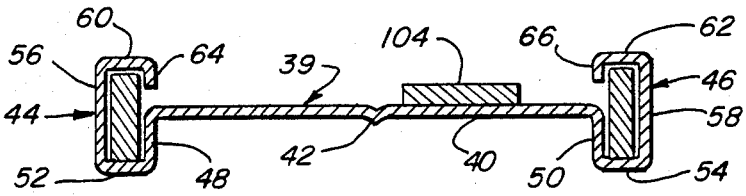
FIG. 4

APPARATUS AND METHOD FOR STRAIGHTENING ELECTROSTATIC PRECIPITATOR COLLECTOR PLATES

BACKGROUND OF THE INVENTION

Electrostatic precipitators are commonly used in the power generating industry to remove certain unwanted particulate from exhaust gases. In the typical construction of an electrostatic precipitator, a plurality of long flat collector plates are hung within a chamber. Electrode wires or rigid frame electrodes are positioned between the plates. An electrostatic charge is generated between the wires and the plates, so that particulate matter is charged on the wires and is collected on the collector plates. The collector plates may have a length of from 20 feet to 50 feet, depending upon the capacity of the particular precipitator. The typical collector plate is generally flat and has edges which are folded in order to stiffen the plates. The plates are secured to hangers, which hangers in turn are hung on beams. The collector plates are usually fabricated from a roll of a cold rolled steel. Fabrication of the collector plates includes flatening the cold rolled steel. Sometimes, this process is imperfect and the collector plates are fabricated with a bow in them. Sometimes, when the collector plates are hung, the plates tend to bow also. It is desirable to have a uniform spacing from each plate to the electrode wires. Obviously, if the wires are straight and the plates are bowed, the spacing is not uniform. It follows that it is desirable to straighten the plates.

A present accepted method of straightening the long plates is to heat and quench selected portions of the plates after they have been hung, and depend upon the expansion and contraction of the metal to straighten the plates. The common method of heating the plates is to use torches to apply heat to specific areas of each plate. Since the specific area to be heated, the amount of heat required, the area to be quenched and the degree of quenching required is a matter of judgement, the results depend upon the skill and experience of the workman. It is unusual to successfully straighten plates utilizing this method and it requires considerable man hours of effort. Many times, the effort results only in collector plates that are more distorted than prior to the heating and quenching operation. It has also been found that a problem sometimes developes in that the plates which have been straightened utilizing the heat and quenching method become bowed in another direction after a short period of time.

It is known to provide a precipitator construction wherein the precipitator plates are held at both the top and the bottom. This construction is taught in U.S. Pat. No. 3,892,545, issued July 1, 1975, entitled, "Arrangement For Suspending And Controlling Precipitation Electrodes". The inventor is Rolf Goransson, of Vaxjo, Sweden. Holding the plates at the top and at the bottom still does not prevent the center from bowing, which gives the non-uniform spacing between the electrode wires and the collector plate.

SUMMARY OF THE INVENTION

The present invention relates to an improved construction for use in an electrostatic precipitator having a plurality of substantially vertical collector plates and a method for straightening the plates. An elongated bar is inserted in an edge of a collector plate. An offset bracket is fixed to the bar. A connector has one end fixed to a support for the plate or to other stationary hardware. A lock secures the bracket to the connector in a selected attitude. The bracket is selectively positioned relative to the support for the plate for holding the bar in a selected attitude relative to the plate to apply a torque moment to the plate to straighten the plate.

BRIEF DESCRIPTION OF THE DRAWINGS

FIG. 1 is a front elevational view of a plurality of collector plates hung on a support in an electrostatic precipitator;

FIG. 2 is a side elevational view of a plurality of collector plates hung on a support in an electrostatic precipitator showing the plates having a bow and the spacing relationship of the bowed plates with an electrode wire;

FIG. 3 is a side elevational view of one of the bowed collector plates of the electrostatic precipitator shown in FIG. 2, but shown with a torque bar mounted in cooperation with the collector plate to straighten the plate;

FIG. 4 is an enlarged cross sectional view taken on Line 4—4 of FIG. 3;

DESCRIPTION OF THE PREFERRED EMBODIMENT

Figure 5:
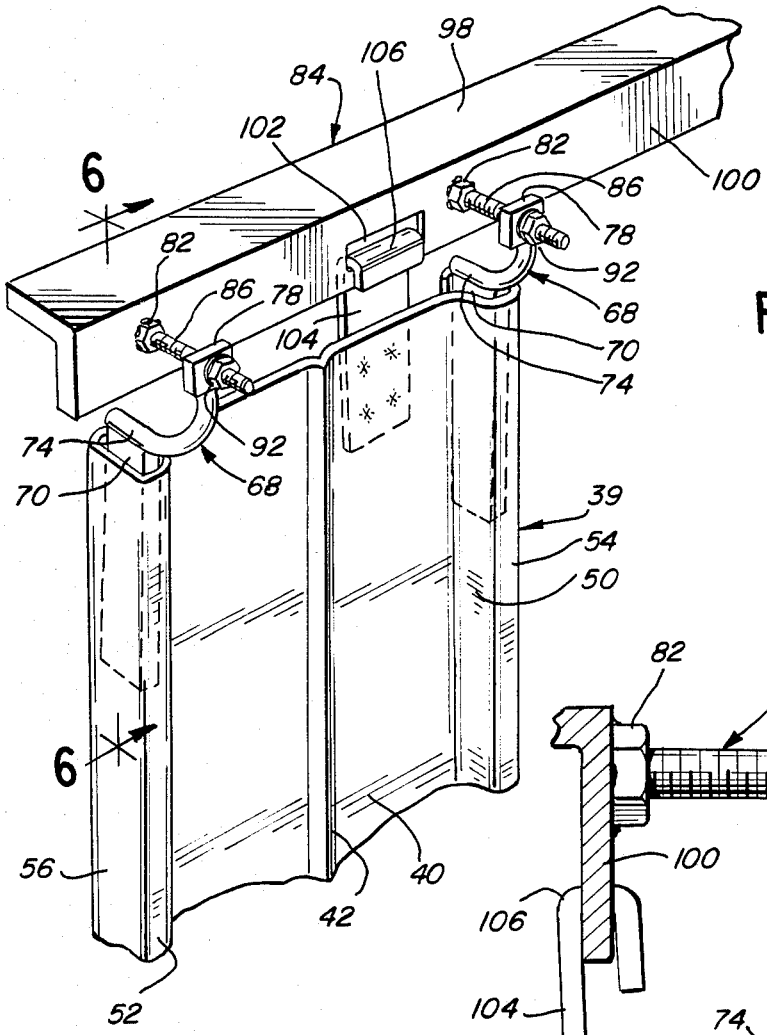
FIG. 5 is an enlarged fragmentary perspective view of the plate shown in FIG. 3 showing a pair of torque bars mounted in cooperation with the plate.

Referring now to the drawings, a portion of a conventional electrostatic precipitator is shown in FIG. 1, wherein a conventional angle iron support 10 is shown with three identical electrostatic precipitator collector plates 12, 14, and 16, secured to the support by conventional hooks 18, 20, and 22, respectively. The lower portion of each of the plates is held in position by a pair of rails.

Looking now to FIG. 2, support 10 and two other identical supports 26 and 28 are shown therein. Plate 16 is shown supported on support 10 and plates 30 and 32 are hung on supports 26 and 28 by hooks 34 and 36, respectively. The bottom of each of the collector plates 16, 30, and 32 is held in position by pairs of rails 24, 35 and 37, respectively.

The conventional construction of an electrostatic precipitator includes a plurality of discharge wires 38 positioned between the plates on different supports. The discharge wires 38 are shown diametrically in FIG. 2. It is to be noted that the discharge wires are straight and are held substantially vertically.

The collector plates ordinarily have a length from 20 feet to 50 feet, depending upon the size of a particular electrostatic precipitator. In this instance, the electrostatic collector plates shown in the drawing all have the same cross sectional construction. As may be seen in FIGS. 3 and 4, collector plate 39 includes a plate body 40 with a rib 42 formed integral with the center portion of the body extending along the entire length of the body. A pair of edges 44 and 46 is formed integral with opposed edges of plate body 40. Offset walls 48 and 50 are formed integral with opposite edges of the body and are perpendicular to the body. Feet 52 and 54 are formed integral with offset walls 48 and 50, respectively, and are substantially parallel to plate body 40.

Side walls 56 and 58 are formed integral with feet 52 and 54, respectively, which side walls are perpendicular to plate body 40. Heads 60 and 62 are formed integral with the side walls 56 and 58, respectively, and are parallel to feet 52 and 54. Lips 64 and 66 are formed integral with heads 60 and 62, respectively, and are substantially parallel to and aligned with offset walls 48 and 50, respectively. The instant construction of edges 44 and 46 tends to stiffen the plates.

It has been observed that even when plates are new, there is sometimes a bow to the plates, so that the plates are closer to the discharge electrode wire 38 at the center than at the top and bottom of the plates, thereby decreasing the efficiency of the electrostatic precipitator. It is therefore desirable to straighten the plates.

A torque bar 68 is positioned in each of the edges of the collector plate to apply a torque moment to the collector plate at the edge and thereby straighten the plate.

Figure 6:
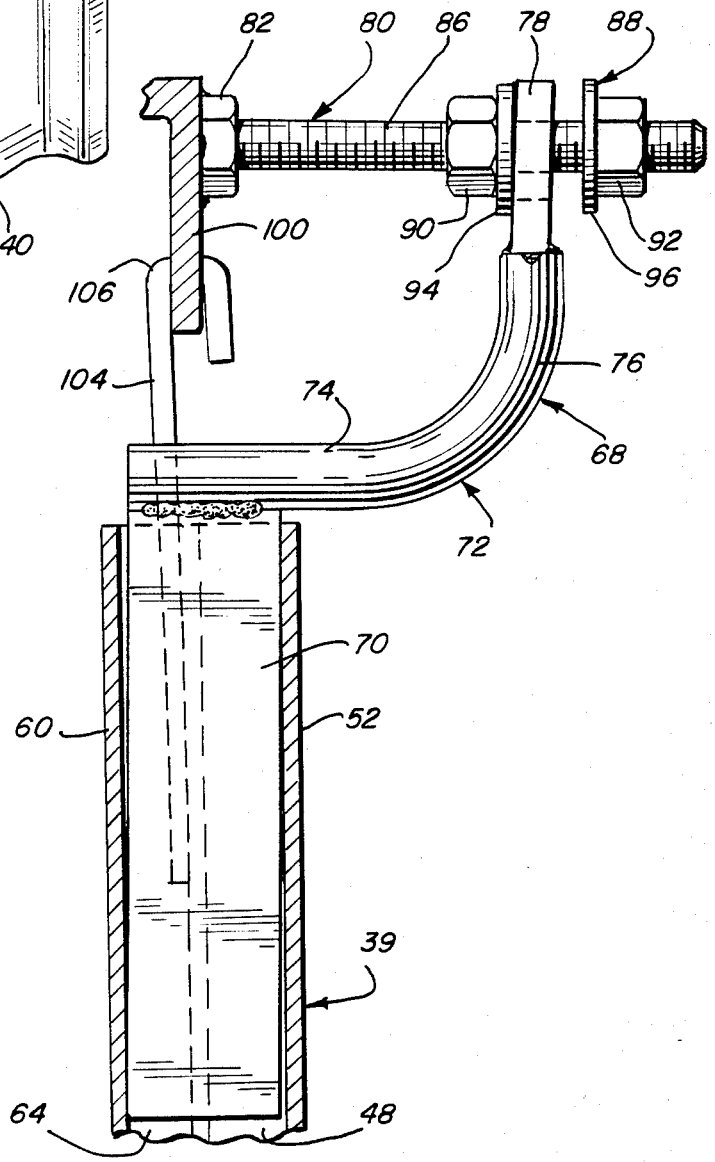
FIG. 6 is an enlarged fragmentary cross sectional view taken on Line 6—6 of FIG. 5.

In the present specific embodiment for a given precipitator, each of the torque bars 68 is identical to the other torque bar. FIGS. 5 and 6 show the construction of the herein disclosed torque bars. The details of the torque bar design are modified to adapt to the particular design of the collecting plates. Each torque bar includes an elongated bar 70. The bar 70 is positionable within either of the edges 44 or 46. A bracket 72 extends from the upper end of elongated bar 70. Bracket 72 includes a base 74 which is substantially perpendicular to the length of elongated bar 70. Base 74 is attached to the end of elongated bar 70. A curved arm 76 has one end formed integral with one end of base 74 and has its other end substantially perpendicular to base 74, as may be best seen in FIG. 6. A connector plate 78 is formed integral with arm 76 in an attitude substantially perpendicular to base 74.

The torque bar includes a connector 80. Connector 80 includes a nut 82 which is fastened by welding or other means to an angle iron support 84, which is identical in construction to angle iron supports 10, 26, and 28. The connector includes an elongated threaded rod 86 which is threadedly mounted in nut 82. The threaded rod is movably mounted in an enlarged aperture in connector plate 78. A lock 88 is threadedly mounted on threaded rod 86 on opposite sides of connector plate 78. Lock 88 includes a pair of conventional locking nuts 90 and 92 on opposite sides of connector plate 78. Conventional washers 94 and 96 are mounted on threaded rod 86 between connector plate 78 and nuts 90 and 92, respectively.

In this instance, angle iron support 84 is conventional in its construction, in that it includes a horizontal arm 98 and a vertical arm 100. The vertical arm includes a hook slot 102. Collector plate 39 includes a hook 104, which is welded to plate body 40, as is conventional. The hook includes a head 106 which passes through slot 102 to support the collector plate on the angle iron support.

In order to straighten collector plate 29, which is originally bowed in the manner shown for collector plates 16, 30, and 32, torque bars 68 are applied to the collector plate and the support. The elongated bars are placed in the edges of the collector plates. Nuts 82 of the connectors are welded to the vertical arm of the support. In the event that the collector plate is bowed in the manner shown for collector plates 16, 30, and 32, nut 90 of each torque bar is moved toward the respective connector plate, thereby applying a force to a collector plate to move the collector plate away from the support. Thus, the elongated bars engage the respective feet of the respective edges. Continued movement of each connector plate then causes the upper edge of each elongated bar to engage the edge near the upper end of the plate and the lower end of each elongated bar to engage its respective head, thereby applying a torque moment to the collector plate, thereby substantially straightening the plate. It may be appreciated that a small displacement of the upper edge of the collector plate is sufficient to straighten the bow of the collector plate.

Once the appropriate position of each locking nut is attained, each locking nut is simply left in position to hold the connector plate in the selected attitude, whereby an appropriate torque is applied to the collector plate to straighten the bow in a collector plate.

In the event that there is a bow in the opposite direction, then a torque is applied to the collector plate in the opposite direction by moving each nut 92 toward the support, then the upper portion of each elongated bar engages the head, while the lower portion of each elongated bar engages the foot to apply a torque in the opposite direction. A torque applied in the opposite direction straightens the bow in the collector plate in the opposite direction.

Although a specific apparatus and method has been shown in the accompanying drawings and described in detail above for use with a specific precipitator construction, it is readily apparent that those skilled in the art may make various modifications and changes without departing from the spirit and scope of the herein disclosed invention. It is to be expressly understood that the present invention is limited only by the appended claims.

What is claimed is:

1. In an electrostatic precipitator having a plurality of substantially vertical collector plates held by a support with electrodes positioned between the collector plates, the improvement comprising; an elongated bar connected to one of the collector plates adjacent to one end of the plate, a bracket fixed to the bar, a connector having one end fixed relative to the support, and a lock connected to the bracket securing the bracket to the connector at a selected position so as to hold the bar in a selected attitude relative to the plate and to apply a torque to the one end of the plate.

2. In an electrostatic precipitator having a plurality of substantially vertical collector plates held by a support with electrodes positioned between the collector plates as defined in claim 1, wherein the bracket includes a connector plate substantially parallel to the elongated bar, and said lock being engageable with the connector plate for retaining the connector plate relative to the connector to hold the elongated bar in a selected position relative to its respective collector plate.

3. In an electrostatic precipitator having a plurality of substantially vertical collector plates held by a support with electrodes positioned between the collector plates as defined in claim 1, wherein the connector includes a threaded rod having one end fixed relative to a portion of the electrostatic precipitator, and said lock being a traveling nut threadedly mounted on the threaded rod, said nut connected to the bracket for retaining the bracket relative to the threaded rod to hold the elongated bar in a selected attitude relative to the respective collector plate.

4. In an electrostatic precipitator having a plurality of substantially vertical collector plates held by a support with electrodes positioned between the collector plates as defined in claim 1, wherein said bracket includes a base fixed to one end of the elongated bar, and a connector plate connected to the base and being substantially parallel to the length of the elongated bar; said connector including a nut secured to a fixed portion of the electrostatic precipitator, and a threaded rod threadedly mounted in the nut; and said lock being a traveling nut threadedly mounted on the threaded rod and in engagement with the connector plate for positioning the base relative to the threaded rod to hold the elongated bar in a selected attitude relative to the respective collector plate.

5. A torque bar construction adapted for straightening an elongated collector plate mounted in an electrostatic precipitator, comprising; an elongated bar adapted for connection in a substantially vertical attitude to a portion of an electrostatic precipitator collector plate, said elongated bar having an upper end, a bracket connected to the upper end of the bar, a connector having one end adapted for connection to a fixed portion of the precipitator, and a lock connected to the connector and securing the connector to the bracket for holding the elongated bar in a selected attitude relative to the fixed portion of the precipitator and in relation to the precipitator collector plate to apply a torque to the collector plate.

6. A torque bar construction adapted for straightening an elongated collector plate mounted in an electrostatic precipitator as defined in claim 5, wherein the connector includes, a nut adapted for being secured to the fixed portion of the electrostatic precipitator, and a threaded rod threadedly mounted in the nut; and said lock being a traveling nut threadedly mounted on the thread rod and being in engagement with the bracket for positioning the bracket relative to the thread rod to hold the bracket in a selected position.

7. A torque bar construction adapted for straightening an elongated collector plate mounted in an electrostatic precipitator as defined in claim 5, wherein said bracket includes a base fixed to one end of the elongated bar, an arm formed integral with one end of the base extending from the base, said arm having a portion substantially perpendicular to the base, a connector plate formed integral with one end of the arm, said connector plate receiving the connector and being in engagement with the lock for securing the connector to the connector plate.

8. A torque bar construction adapted for straightening an elongated collector plate mounted in an electrostatic precipitator as defined in claim 5, wherein the bracket includes a connector plate being fixed relative to the elongated bar and being substantially parallel to the elongated bar, said connector including a threaded rod having one end fixed to a fixed portion of the electrostatic precipitator.

9. A torque bar construction adapted for straightening an elongated collector plate mounted in an electrostatic precipitator as defined in claim 5, wherein the connector includes an elongated threaded rod, said connector having one end adapted for being secured to the fixed portion of the electrostatic precipitator, said lock being mounted on the threaded rod and being connected to the bracket for positioning the bracket relative to the threaded rod to hold the elongated bar in a selected attitude relative to the collector plate, said bracket including a base fixed to one end of the elongated bar, an arm having one end formed integral with the base and having a portion substantially parallel to the elongated bar, and a connector plate formed integral with the arm, said connector plate receiving the threaded rod and being in engagement with the lock for securing the threaded rod to the connector plate.

10. A torque bar construction adapted for straightening an elongated collector plate mounted in an electrostatic precipitator as defined in claim 5, wherein said bracket includes a base fixed to one end of the elongated bar, an arm having one end formed integral with the base and being substantially parallel to the length of the elongated rod, a connector plate formed integral with the arm and being substantially parallel to the length of the elongated rod; said connector including a nut adapted for being secured to the fixed portion of the electrostatic precipitator, and a threaded rod having one end threadedly mounted in the nut; and said lock including a traveling nut threadedly mounted on the threaded rod and being in engagement with the connector plate for positioning the connector plate relative to the threaded rod to hold the elongated rod in a selected attitude relative to the precipitator plate.

11. A method of straightening a collector plate in an electrostatic precipitator wherein the collector plate is bowed comprising the following steps; connecting an elongated bar to the collector plate, securing one end of a connector to a fixed portion of the electrostatic precipitator, applying a torque moment to the elongated bar to apply a torque moment to the plate to remove the bowed condition, and locking the elongated bar relative to the connector to hold the torque bar in a selected attitude relative to the collector plate to hold the plate in an unbowed condition.

12. A method of straightening a collector plate in an electrostatic precipitator as defined in claim 11, wherein said collector includes a nut secured to said fixed portion of the electrostatic precipitator and a threaded rod threadedly mounted in the nut, said threaded rod is connected to the elongated bar.

13. A method of straightening a collector plate in an electrostatic precipitator as defined in claim 11, wherein a connector plate is secured to the elongated bar, a traveling nut is threadedly mounted on the connector, and the application of a torque moment to the elongated bar is effected by moving the traveling nut along the connector in engagement with the connector plate.

14. A method of straightening a collector plate in an electrostatic precipitator as defined in claim 11, wherein the connector is connected to a connector plate, said connector plate is connected to the elongated bar and is substantially parallel to the length of the elongated bar, and a nut is threadedly mounted on the connector so as to connect the connector to the connector plate and to releasbly lock the bar in a selected attitude relative to the connector.

* * * * *

UNITED STATES PATENT AND TRADEMARK OFFICE

CERTIFICATE OF CORRECTION

PATENT NO. : 4,516,992

DATED : May 14, 1985

INVENTOR(S) : Robert E. Jonelis

It is certified that error appears in the above-identified patent and that said Letters Patent are hereby corrected as shown below:

Col. 3, Line 58, cancel "29" and substitute therefor --39--

Signed and Sealed this

*Twentieth* Day of *August 1985*

[SEAL]

*Attest:*

DONALD J. QUIGG

*Attesting Officer*

*Acting Commissioner of Patents and Trademarks*